US006085709A

United States Patent [19]

Freese, V

[11] Patent Number: 6,085,709

[45] Date of Patent: Jul. 11, 2000

[54] ENGINE ROCKER ARM COVER HAVING REDUCED NOISE TRANSMISSION

[75] Inventor: Charles Edwin Freese, V, Westland, Mich.

[73] Assignee: Detroit Diesel Corporation

[21] Appl. No.: 09/224,128

[22] Filed: Dec. 10, 1998

[51] Int. Cl.[7] ..... F02B 77/00; F02F 7/00

[52] U.S. Cl. ..... 123/90.38; 123/195 C; 123/198 E

[58] Field of Search ..... 123/90.38, 195 C, 123/198 E

[56] References Cited

U.S. PATENT DOCUMENTS

| | | | |
|---|---|---|---|
| 4,492,189 | 1/1985 | Ogawa et al. | 123/90.38 |
| 4,498,433 | 2/1985 | Ogawa | 123/90.38 |
| 4,522,165 | 6/1985 | Ogawa | 123/195 C |
| 4,593,659 | 6/1986 | Wells et al. | 123/90.38 |
| 5,323,740 | 6/1994 | Daily et al. | 123/90.38 |
| 5,513,603 | 5/1996 | Ang et al. | 123/90.37 |

*Primary Examiner*—Weilun Lo
*Attorney, Agent, or Firm*—Bill C Panagos

[57] ABSTRACT

The rocker arm cover on a diesel engine can be formed of a rigid molded plastic material to minimize the transmission of noise into the atmosphere. Sonic vibration of the cover can be reduced by reducing the cover material stiffness. The reduced stiffness of the cover material allows the roof area of the cover to be momentarily displaced away from the cylinder head in the presence of an acoustic wave, so that the roof area is not able to develop the restoring force that is necessary for vibrational motion.

6 Claims, 3 Drawing Sheets

ENGINE ROCKER ARM COVER HAVING REDUCED NOISE TRANSMISSION

BACKGROUND OF THE INVENTION

The present invention relates to engine rocker arm covers, and particularly to an engine rocker arm cover having means for reducing the noise associated with normal operation of the rocker arms and other engine components.

The present invention further relates to an engine noise cover having means for reducing the noise associated with normal operation of an internal combustion engine, and particularly with the operation of diesel engines.

SUMMARY OF THE INVENTION

Modem diesel engines often generate louder (harsher) noises than spark ignition engines. Some of the noise generated by the diesel engine results from normal operation of the engine rocker arms. Some additional noise is generated by the compression ignition process that is used in diesel engines.

A considerable portion of the engine noise is transmitted to the environment through the rocker arm chambers and associated rocker arm covers. The rocker arm cover(s) act as a sounding board for transmitting sonic vibrations into the atmosphere.

The present invention relates to an engine rocker arm cover designed to minimize the transmission of sonic vibrations (noises) to the ambient atmosphere. As one feature of the invention, the rocker arm cover is formed out of a plastic material having a lessened capacity for vibration in response to sonic waves generated within the rocker arm chamber.

As a second feature of the invention, the rocker arm cover is provided with a lining formed of a sound absorbing material, e.g. rubber, foam rubber, or plastic foam material.

As a third feature of the invention, the rocker arm cover is formed or constructed so that the roof portion of the cover is adapted to be displaced from its normal position in response to the force of an acoustic wave. A slight movement of the cover roof away from the associated engine cylinder head effectively accommodates or relieves the sonic wave, such that the cover is precluded from vibrating in resonance with the wave. The rocker arm cover is thereby prevented from acting as a sounding board for rebroadcasting the sonic wave (noise).

Specific features of the invention will be apparent from the attached drawings and description of an illustrative embodiment of the invention.

DESCRIPTION OF A PREFERRED EMBODIMENT OF THE INVENTION

Figure 1:
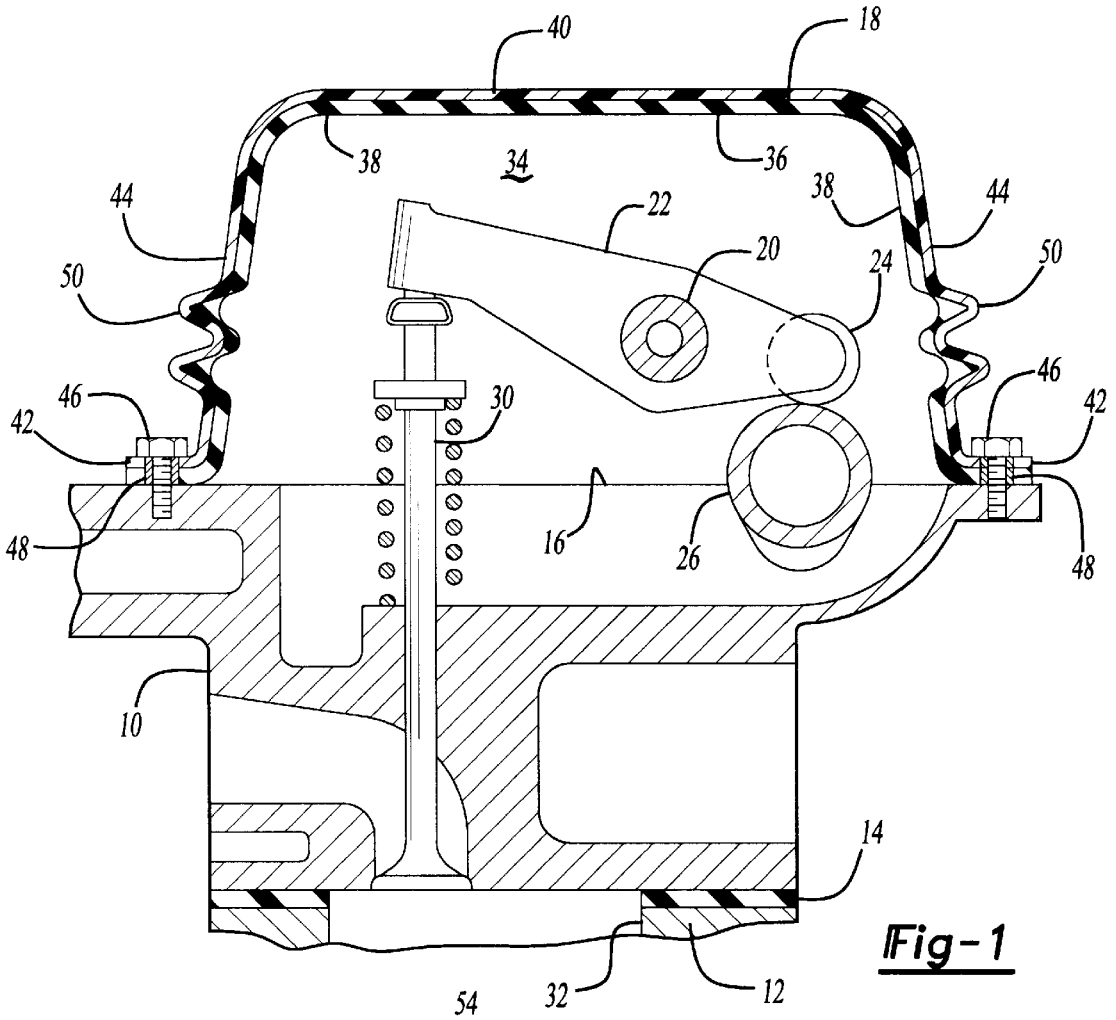
FIG. 1 is a fragmentary sectional view taken through a diesel engine equipped with a rocker arm cover constructed according to the present invention.

Referring to FIG. 1, there is shown a generally conventional diesel engine having a cylinder head 10 suitably secured to an engine block 12. The cylinder head has a lower face 14 secured to block 12 and an upper face 16 adapted to mount a rocker arm cover 18. A rocker arm shaft 20 rotatably supports plural rocker arms 22 at spaced points along the shaft length. Each rocker arm has a roller 24 that rides on a cam shaft 26 that is located on the parting plane between cylinder head 10 and the rocker arm cover 18. Each rocker arm has a free end that is linked to a valve 30. The drawing shows one valve 30. However, it will be appreciated that the engine has a number of similarly constructed valves. Typically, there are two or four valves 30 for each combustion cylinder 32, i.e. one or two intake valves and one or two exhaust valves.

The invention is more particularly concerned with the construction of rocker arm cover 18, especially with features of the rocker arm cover designed to reduce engine noise emissions. The rocker arm cover illustrated in FIG. 1 is formed out of a rigid plastic material preferably by a blow molding process. The use of a rigid plastic for the cover material is advantageous over the use of conventional sheet metal, in that the cover has a reduced (lessened) tendency to vibrate in response to sonic vibrations generated within the rocker arm chamber 34. Such sonic vibrations can be produced by the pressure-ignited combustion process in the engine cylinders, and also by the reciprocable motions of the rocker arms.

As a further feature of the invention, the rocker arm cover is provided with a lining 36 of a sound-absorbing material. Typically, lining 36 will be a rubber foam material or a plastic foam material having multiple pores, or cells, distributed throughout the lining material. Each pore or cell has the ability to absorb, or trap, sonic vibrations, thereby reducing the intensity of the sonic wave that impacts on the inner surface of plastic cover 18.

The atmosphere in chamber 34 includes oil mist particles that can collect on the exposed surface of acoustic lining 36. In order to prevent such oil particles from migrating into the pores in lining 36, the lining is preferably provided with an imperforate skin that forms an exposed lining surface 38.

Rocker arm cover 18 comprises a roof 40, peripheral flange 42, and upstanding annular side wall 44 connecting the roof to the peripheral flange. Preferably, the rocker arm cover is a one-piece plastic molding formed by a blow molding operation.

The rocker arm cover 18 is secured to cylinder head 10 by multiple bolts 46 extending through peripheral flange 42 into threaded holes in the face of cylinder head 10. Peripheral areas of acoustic lining 36 form an oil seal around the rocker arm chamber. Over-compression of the acoustic lining material can be prevented by encircling each bolt 46 with a compression limiter sleeve 48.

As a principal feature of the invention, the rocker arm cover is provided with means for substantially reducing vibratory motion of the rocker arm cover roof 40 resulting from the generation or transmission of acoustic waves within chamber 34. As shown in FIG. 1, the means for reducing vibratory motion of rocker arm cover roof 40 comprises an annular bellows 50 incorporated into the annular side wall 44 of cover 18. Annular bellows 50 reduces the stiffness of side wall 44, and the ability of the side wall to act as a fulcrum for vibratory motion of roof 40.

Sonic vibrations applied to thin walls can cause the wall to vibrate at the frequency of the sonic wave, such that the wall acts as a sounding board for rebroadcasting the sonic wave to the ambient atmosphere. The ability of the wall to vibrate in resonance with the sonic wave is affected, or influenced, by the mass of the wall, its stiffness, and its thinness. A thinner plate (wall) will more readily vibrate, as compared to a thicker wall. Likewise a stiffer wall will have a greater tendency to vibrate than a less stiff (more flexible) wall. However, the stiffness of the rocker cover structure must be tuned to avoid resonance within the operating excitation frequency range of the engine. This tuning requires adjusting the cover's stiffness and mass to move the natural frequency outside the excitation frequency range.

In the FIG. 1 environment, an internal sonic wave impinging on a stiff roof 40 will initially deflect the roof away from cylinder head 10. Assuming that annular bellows 50 is not present, the stiff roof will be stressed so as to have a reactive downward motion toward cylinder head 10. The reactive movement will tend to overshoot the initial roof position, so that a vibratory motion will be induced into the roof. The next sonic wave will reinforce the vibratory roof motion, such that cover 18 will act as a sounding board to broadcast the sonic noise into the ambient atmosphere.

Annular bellows 50 reduces the vertical stiffness of annular side wall 44 so that roof 40 has a lessened vibrational capability. As a sonic wave impacts the inner surface of cover 18, roof 40 is deflected outwardly a slight distance, i.e. upwardly away from cylinder head 10. Annular bellows 50 permits the roof to move with the sonic wave to avoid stressing the roof and producing the reactive downward motion toward the cylinder head. The roof therefore does not have a reactive downward motion that is necessary for vibratory motion. Bellows 50 is designed to lessen the vertical stiffness of annular side wall 40, so that the side wall cannot act as a fixed stiffener for roof 40. By preventing, or greatly reducing, the vibrational amplitudinal of roof 40 motion, the bellows prevents roof 40 from acting as a sounding board for the sonic noise produced in the engine.

Figure 2:
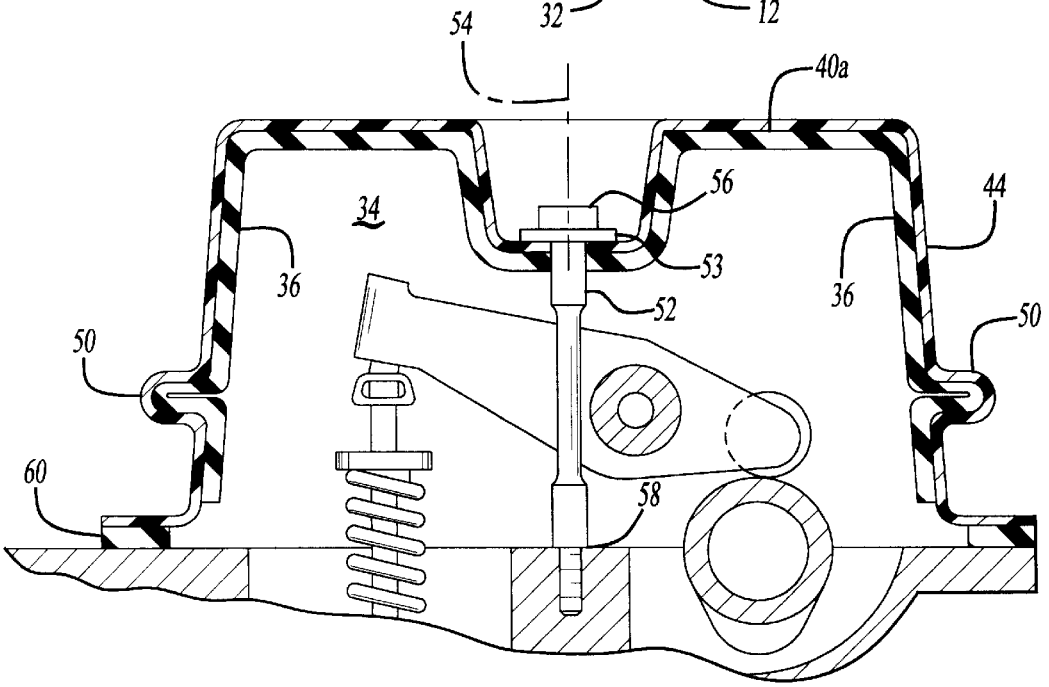
FIG. 2 is a sectional view taken in the same direction as FIG. 1, but showing a further form that the rocker arm cover can take.
Figure 3:
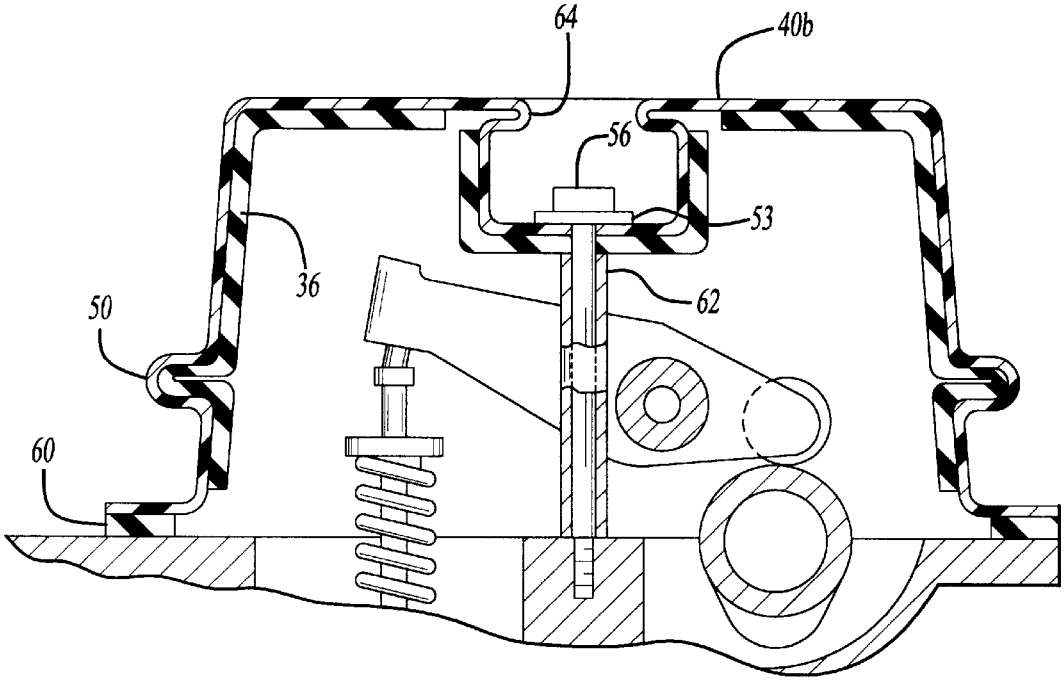
FIG. 3 is a sectional view taken through another rocker arm cover embodying the invention.
Figure 4:
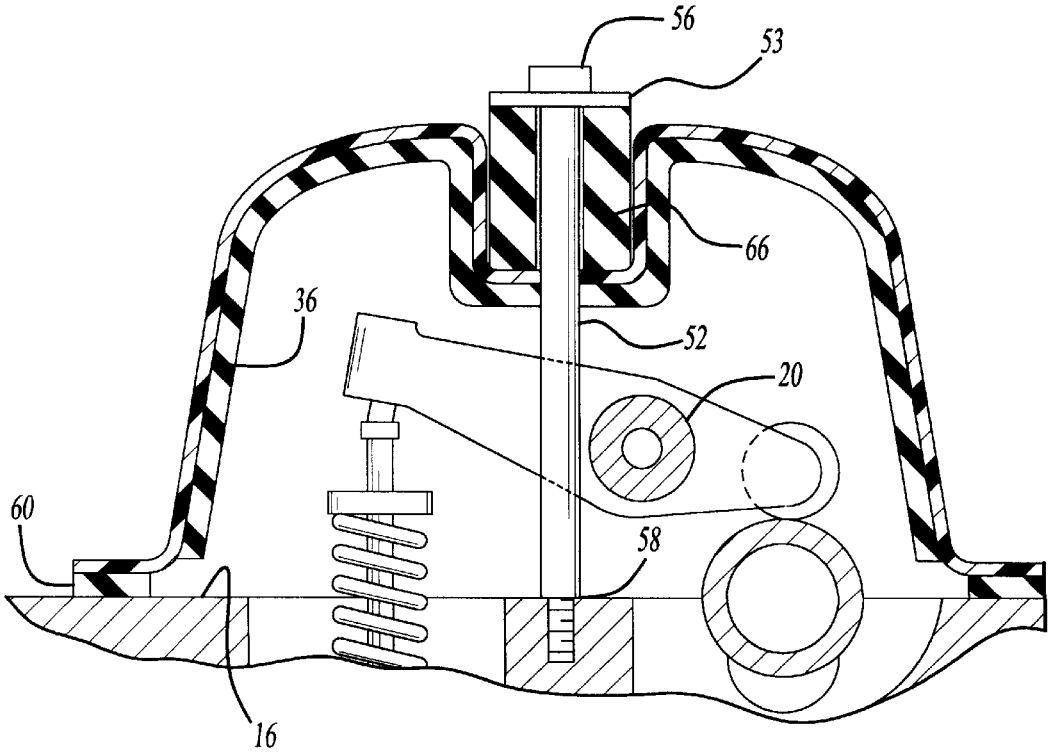
FIG. 4 is a sectional view taken in the same direction as FIG. 3, but showing an additional rocker arm cover constructed according to the invention.

FIGS. 2 through 4 illustrate additional mechanisms that can be used to prevent the rocker arm cover from functioning as a sounding board. FIG. 2 shows a rocker arm cover 18*a* that is secured to cylinder head 10 by multiple bolts 52 spaced along the longitudinal axis 54 of the rocker arm cover. FIG. 2 shows a single bolt 52; however, it will be appreciated that additional bolts are used, at spaced points along the cover longitudinal axis 54. Typically, there will be three bolts 52, spaced apart along axis 54.

Each bolt 52 has a head 56 in pressure engagement with roof 40*a* of the cover; a washer 53 can be provided between the bolt head and the cover surface to reduce unit area forces on the over material. The roof 40*a* is recessed at the bolt 52 locations, to reduce the rocker arm cover silhouette. Each bolt 52 has a threaded lower end anchored in a threaded hole in cylinder head 10. Shoulder 58 on the shank of bolt 52 locates bolt head 56, to achieve a desired sealing pressure between oil seal 60 and the cylinder head surface.

As with the previously-described embodiment, the rocker arm cover includes an annular bellows 50 integrated into side wall 44 of the cover. The bellows performs the function of reducing the axial stiffness of side wall 44, so that roof 40*a* is prevented from acting as a sounding board. The effectiveness of bellows 50 can be enhanced by constructing each bolt 52 so that it is somewhat elastic, within the force levels produced by the sonic vibrations.

FIG. 3 shows a variant of the arrangement depicted in FIG. 2. In FIG. 3, each bolt head 56 is located a predetermined distance above cylinder head surface 16 by an annular pressure-limiter sleeve 62 encircling the bolt shank. Sleeve 62 provides the same functions as shoulder 58 in the FIG. 2 embodiment, namely a means to limit the pressure on annular oil seal 60.

In the FIG. 3 rocker arm cover, an auxiliary bellows 64 is provided between roof 40*b* and the recessed roof area. Bellows 64 allows the major area of roof 40*b* to float upwardly incrementally away from its normal position when the internal surface of the roof is impacted by a sonic wave. Each bellows 64 acts in synchronism with the annular bellows 50 to prevent the roof of the rocker arm cover from generating the reactive downward force necessary for vibratory motion.

FIG. 4 shows a variant of the invention, wherein each cover mounting bolt 52 has its head paced from the aligned roof surface by means of an annular compressible plug 66 surrounding the shank portion of the bolt. Plug 66 provides approximately the same function as bellows 50 in the previously described embodiments.

As a sonic wave impacts the internal surface of the roof on the rocker arm cover, the resilient plug 66 is compressed slightly in the axial direction, thereby permitting the roof to move an incremental distance away from the cylinder head surface 16. The roof is thereby prevented from developing the reactive downward force that is necessary for vibratory motion.

In major respects, the rocker arm cover of FIG. 4 has essentially the same anti-sonic action as the previously described embodiments. A major feature of the invention is the mechanism for reducing, or eliminating, vibratory motion of the rocker arm roof that could otherwise be produced by the presence of acoustic waves in the rocker arm chamber. The mechanism responds to the sonic wave by momentarily permitting the rocker arm cover roof to be displaced away from the cylinder head so that said roof cannot develop the reactive force for a restoring motion toward the cylinder head.

Figure 5:
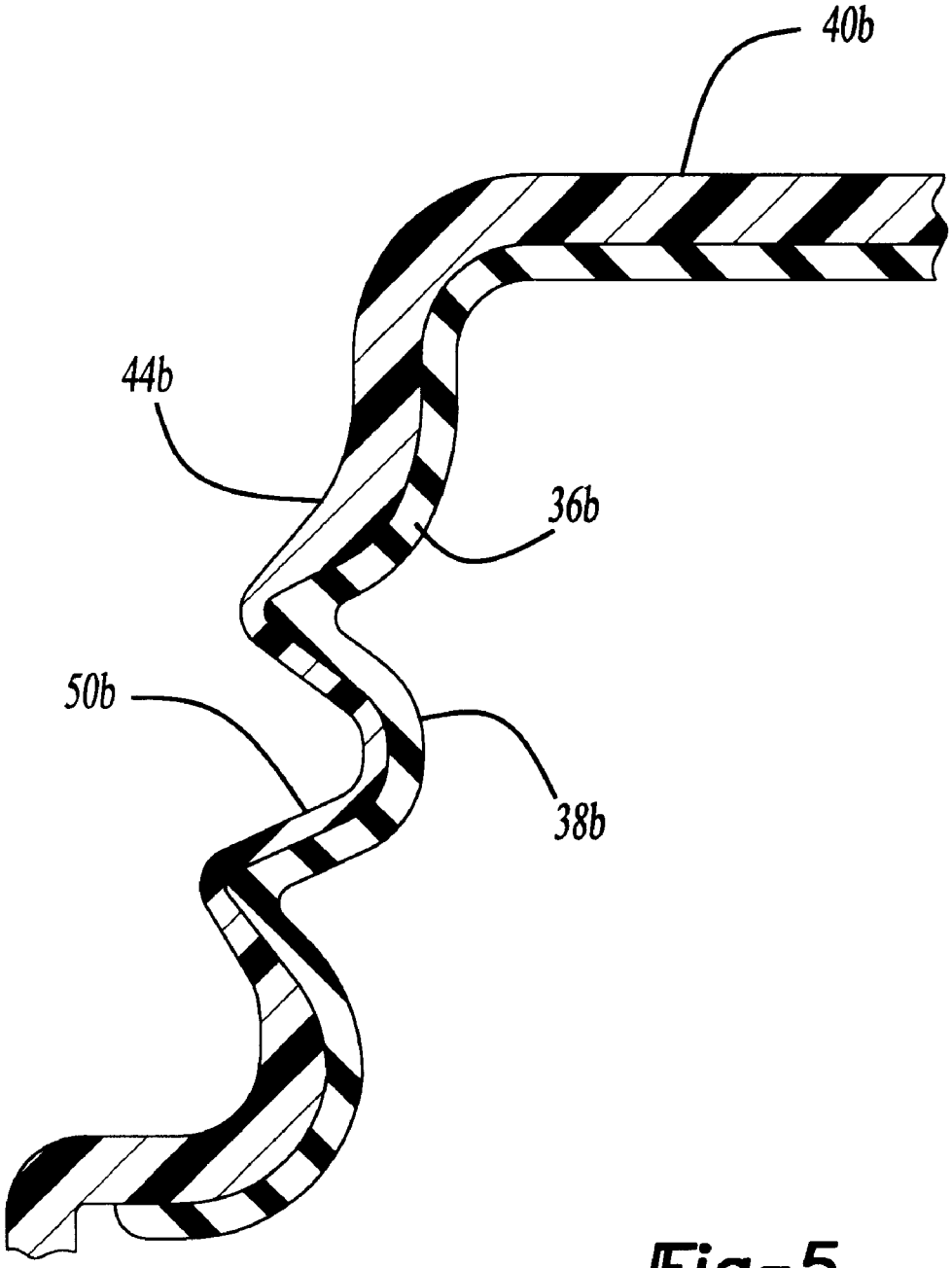
FIG. 5 is a sectional view of another embodiment of the rocker arm cover showing variable thickness in each layer of the cover.

FIG. 5 shows an alternative approach to the concept of the present invention. In this embodiment, the roof 40*b* is of uniform thickness along its length whereas annular side wall 44*b*, and lining 36*b* and imperforate skin 38*b* as they are constructed proximal to annular wall 44*b* are of variable thickness. In addition, annular bellow 50*b* has a thin layer of hard plastic and a thick section of soft, low durometer material for flexibility. It is important to note that varied thicknesses of the high and low durometer materials achieves different resonance characteristics over different regions of the part, thereby dampening the structure's resonance and reducing any noise amplification and rebroadcast.

Those skilled in the art will recognize that a similar approach may be used for engine noise covers, which may be used to envelope the engine. Such devices may serve as a top engine cover, a gearcase cover, or a lower engine compartment cover. In each case, the cover serves as a noise dampening device, utilizing a mechanism similar to those described in the above embodiments.

The present invention has been described in relation to several specific embodiments. Those skilled in the art will understand that many variations and applications are possible and contemplated herein without departing from the scope and spirit of the invention as defined in the appended claims.

What is claimed:

1. In a diesel engine having a cylinder head and a rocker arm cover seated on said cylinder head, the improvement comprising; said rocker arm cover comprising a roof spaced from the cylinder head, a peripheral flange seated on the cylinder head, an annular side wall connecting said roof to said peripheral flange; means mounting said cover on said cylinder head so that said roof has a normal position spaced a predetermined distance from said cylinder head; said cover being a hollow one-piece molded plastic structure having an internal surface and an external surface; and means for substantially reducing vibratory motion of said roof from its normal position due to the generation of acoustic waves within said cover, said motion reducing means comprising a bellows integrated into said annular side wall.

2. The improvement of claim 1, wherein said cover mounting means comprises multiple bolts extending through said peripheral flange at spaced points around said cover.

3. The improvement of claim 1, wherein said rocker arm cover is comprised of composite layers of durometer material having variable thicknesses.

4. The improvement of claim 1, wherein said rocker arm cover is comprised of a composite of a hard plastic material layer, a soft, sound absorbing lining layer, and an oil resistant nonporous material layer.

5. The improvement of claim 1, wherein said motion reducing means comprises means responsive to the force of an acoustic wave on said roof for momentarily causing said roof to be displaced from its normal position in a direction away from the cylinder head.

6. The improvement of claim 1, and further comprising a sound-absorbing lining on the internal surface of said cover.

* * * * *

UNITED STATES PATENT AND TRADEMARK OFFICE

CERTIFICATE OF CORRECTION

PATENT NO. : 6,085,709
DATED : July 11, 2000
INVENTOR(S) : Charles E. Freese, V

It is certified that error appears in the above-identified patent and that said Letters Patent is hereby corrected as shown below:

Column 1,
Line 5, after "BACKGROUND OF THE INVENTION", insert --
This invention was made with Government support under DE-FC05-97 OR22581 awarded by the United States Department of Energy. The Government has certain rights in this invention. --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*